US005931478A

United States Patent [19]

Chang

[11] Patent Number: 5,931,478

[45] Date of Patent: Aug. 3, 1999

[54] IN-LINE ROLLER SKATE WITH AN AUXILIARY WHEEL SYSTEM

[76] Inventor: Yu-Cheng Chang, 2Fl., No. 17, Lane 280, Sec. 1, Hsueh-Fu Rd., Tu-Cheng City, Taipei Hsien, Taiwan

[21] Appl. No.: 08/865,803

[22] Filed: May 30, 1997

[51] Int. Cl.[6] ..... A63C 17/04

[52] U.S. Cl. ..... 280/11.22; 280/11.26; 280/11.27; 180/906

[58] Field of Search ..... 280/11.22, 11.26, 280/11.27

[56] References Cited

U.S. PATENT DOCUMENTS

| | | | |
|---|---|---|---|
| 2,070,646 | 2/1937 | Blochinger | 280/11.27 |
| 2,664,294 | 12/1953 | Kleinman | 280/11.27 |
| 5,295,701 | 3/1994 | Reiber et al. | 280/11.27 |
| 5,513,863 | 5/1996 | Klamer et al. | 280/11.27 |
| 5,620,190 | 4/1997 | Maggiore | 280/11.22 |

*Primary Examiner*—J J Swann
*Assistant Examiner*—Christopher Bottorff
*Attorney, Agent, or Firm*—Bacon & Thomas, PLLC

[57] ABSTRACT

An in-line roller skate including a sole plate equipped with a line of wheels, and an auxiliary wheel system mounted in the sole plate, wherein the auxiliary wheel system includes two auxiliary wheels, and a control device sliding in a sliding way for controlling the auxiliary wheels between a first position in which the auxiliary wheels are retained closely attached together, and a second position in which the auxiliary wheels are spaced from each other at a space.

4 Claims, 6 Drawing Sheets

IN-LINE ROLLER SKATE WITH AN AUXILIARY WHEEL SYSTEM

BACKGROUND OF THE INVENTION

The present invention relates to roller skates for young skaters, and more particularly to an auxiliary wheel system for an in-line roller skate which comprises two auxiliary wheels, and a control device adapted for controlling the pitch between the auxiliary wheels.

The sport of wheels skating has been enjoyed by people of different ages. Recently, a variety of in-line roller skates have been developed. However, it is difficult to learn how to master an in-line roller skate, because the narrow wheel base makes in-line roller skate more unstable. The difficulty of learning how to skate on in-line skates discourages young children to make a trial. U.S. Pat. No. 5,513,863 discloses a multi-function roller skate system which functions as a conventional skate configuration, with the wheels wide apart, and also as an in-line skate configuration, with a single row of wheels. However, this multi-function roller skate system has a complicated structure that is expensive to manufacture and difficult to install.

SUMMARY OF THE INVENTION

It is one object of the present invention to provide an in-line roller skate which is specifically designed for young skaters. It is another object of the present invention to provide an in-line roller skate which has a simple structure that is easy to assemble and to adjust. It is still another object of the present invention to provide an in-line roller skate which is inexpensive to manufacture. To achieve the above and other objects of the present invention, there is provided an in-line roller skate comprising a sole plate equipped with a line of wheels and an auxiliary wheel system mounted in the sole plate, wherein the auxiliary wheel system includes two auxiliary wheels, and a control device sliding in a sliding way for controlling the auxiliary wheels between a first position in which the auxiliary wheels are retained closely attached together, and a second position in which the auxiliary wheels are spaced from each other at a space.

DETAILED DESCRIPTION OF THE PREFERRED EMBODIMENT

Figure 1:
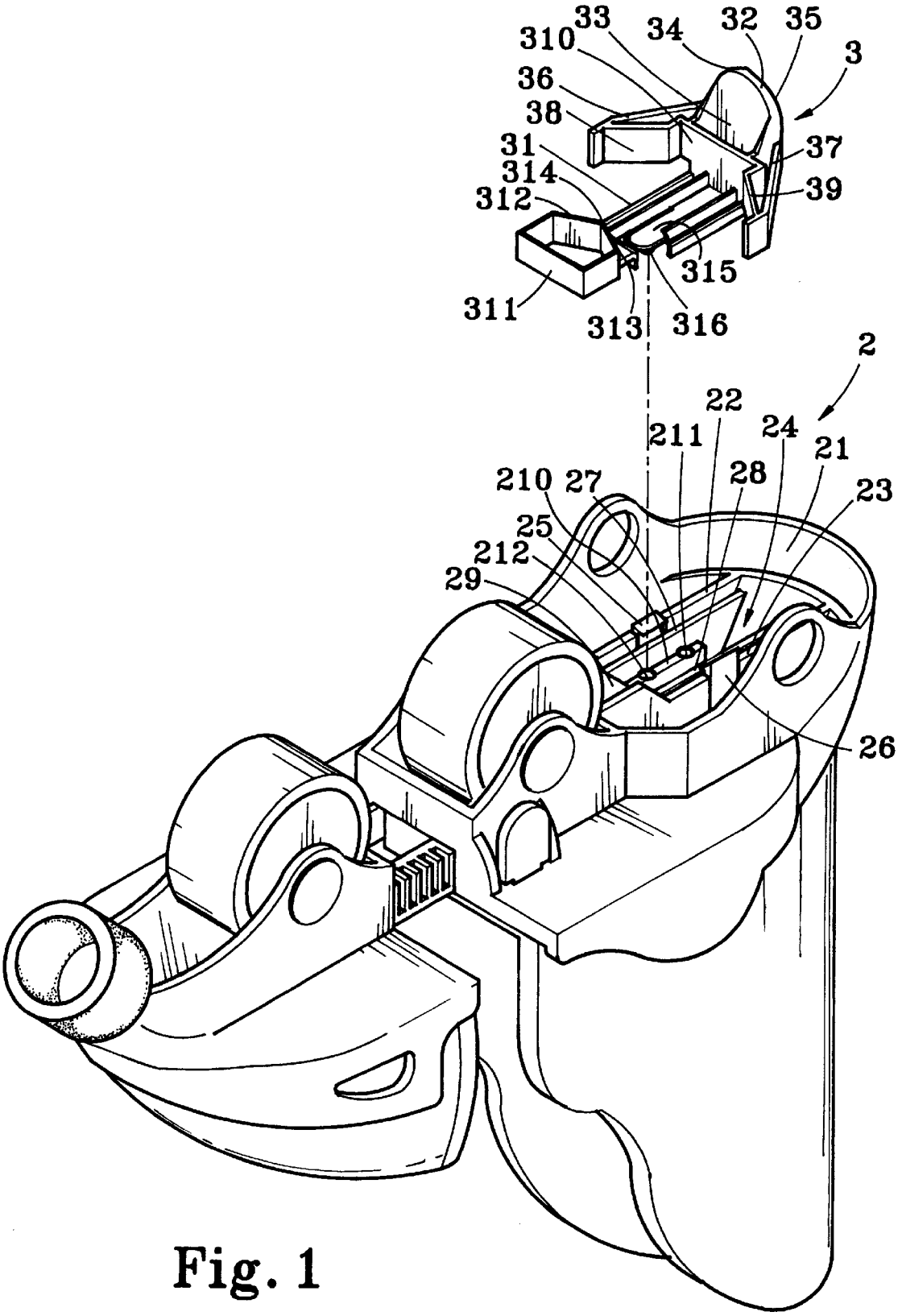
FIG. 1 is an exploded view of an in-line roller skate according to the present invention.

Referring to FIG. 1, the sole plate, referenced by 2, comprises an auxiliary wheel mounting space 21 near a rear end thereof, two partition plates 22;23 bilaterally disposed inside the auxiliary wheel mounting space 21 and defining a longitudinal sliding way 24, a control device 3 mounted within the auxiliary wheel mounting space 21 and moved along the sliding way 24, two locating devices 25;26 respectively mounted on the partition plates 22;23 and adapted to hold the control device 3 in the sliding way 24, two support plates 27;28 bilaterally disposed within the partition plates 22;23 and adapted for supporting the control device 3 in the sliding way 24, a stop plate 29 connected between the partition plates 22;23 at one end and adapted to limit the backward movement of the control device 3 in the sliding way 24, a locating plate 210 spaced between the support plates 27;28 and halting a front locating hole 212 and a rear locating holes 211 for the positioning of the control device 3. The control device 3 comprises a base frame 31, a finger plate 32 disposed at one end of the base frame 31, a finger slot 33 and two finger grooves 34;35 disposed at two opposite sides of the finger plate 32 into which the fingers are inserted to hold the finger plate 32 and to move it along the sliding way 24, two arms 36;37 bilaterally extended from the finger plate 32 and having a respective oblique push face 38;39, a receiving space 310 defined between the arms 36;37, an actuating frame 311 disposed at one end of the base frame 31 remote from the finger plate 32 and having two oblique planes 312;313 facing the push faces 38;39 of the arms 36;37 and met at an actuating end 314, and a locating spring plate 315 disposed in the base frame 31 in front of the receiving space 310 and having a raised portion 316 at its bottom side.

Figure 2:
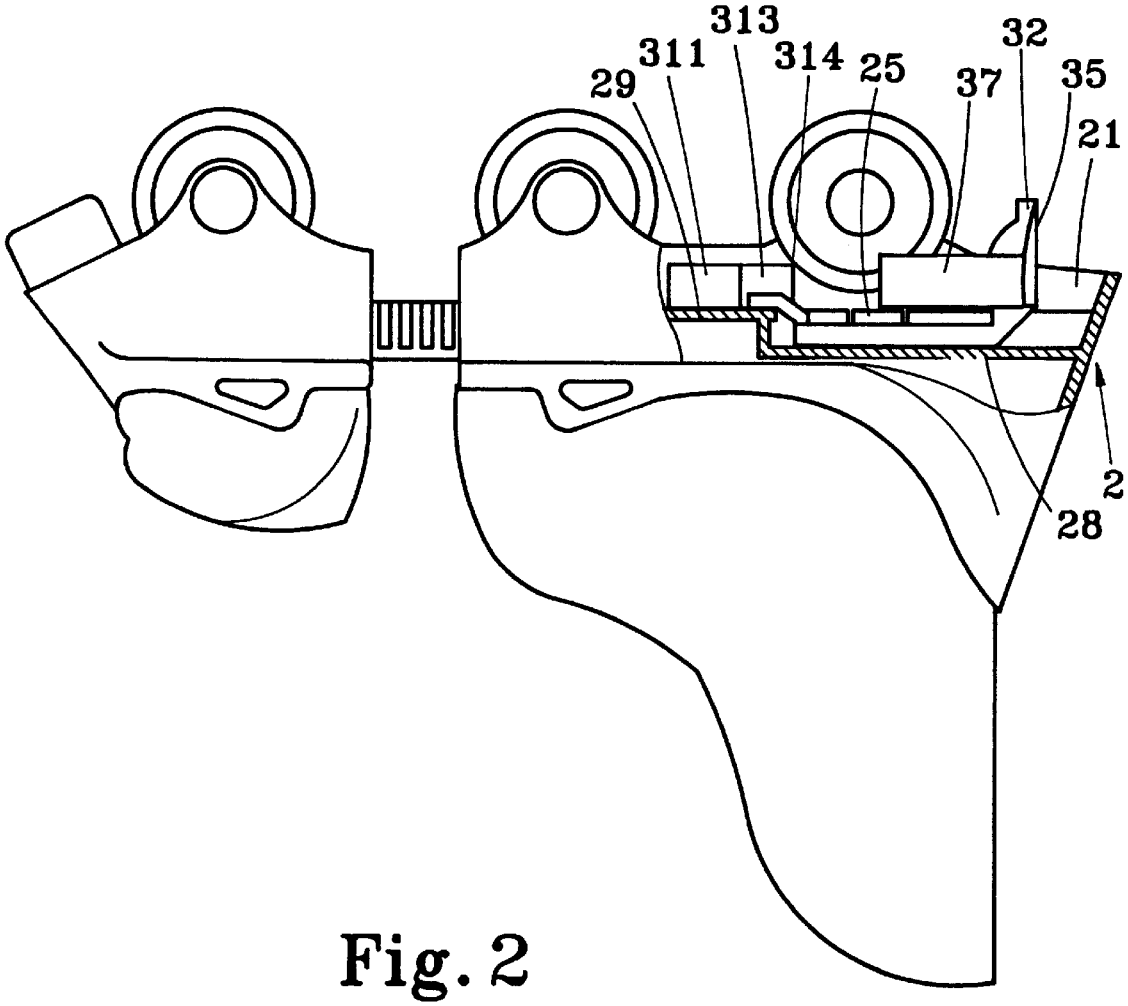
FIG. 2 is a side view of the present invention.
Figure 3:
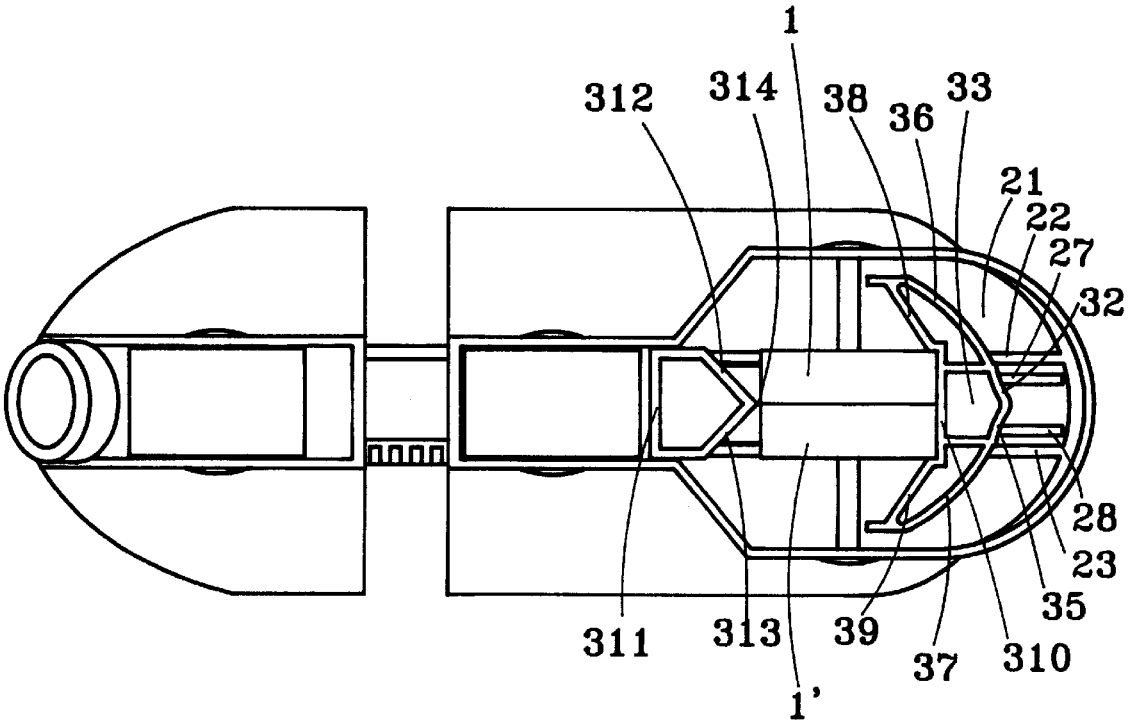
FIG. 3 is a bottom view of the present invention.
Figure 6:
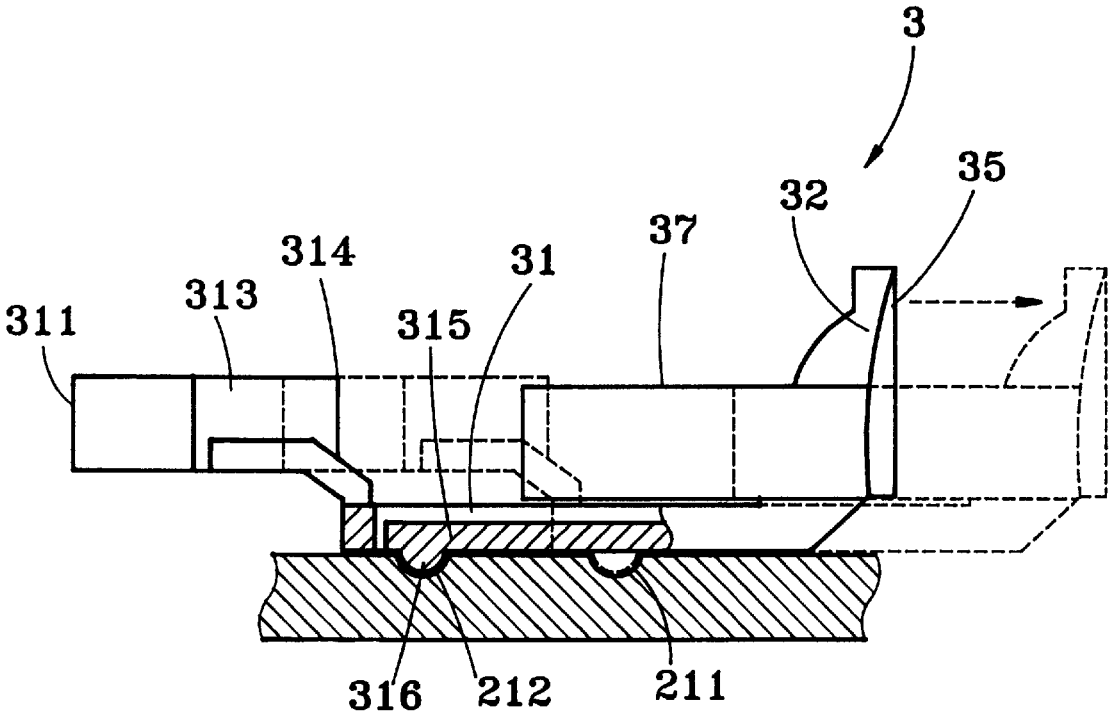
FIG. 6 is a schematic drawing showing the raised portion of the spring plate moved between the locating holes of the locating plate according to the present invention.

Referring to FIGS. 2 and 3, two auxiliary wheels 1;1' are mounted in parallel on a transverse axis in the auxiliary wheel mounting space 21 of the sole plate 2. When the control device 3 is pushed forwards, the arms 36;37 are moved toward the auxiliary wheels 1;1', causing the oblique push faces 38;39 to push the auxiliary wheels 1;1' toward each other. When the auxiliary wheels 1;1' are abutted against each other, they are received in the receiving space 310, and at the same time the raised portion 316 of the spring plate 315 is forced into engagement with the front locating hole 212, and therefore the auxiliary wheels 1;1' are firmly retained in the closely attached status (see FIG. 6).

Figure 4:
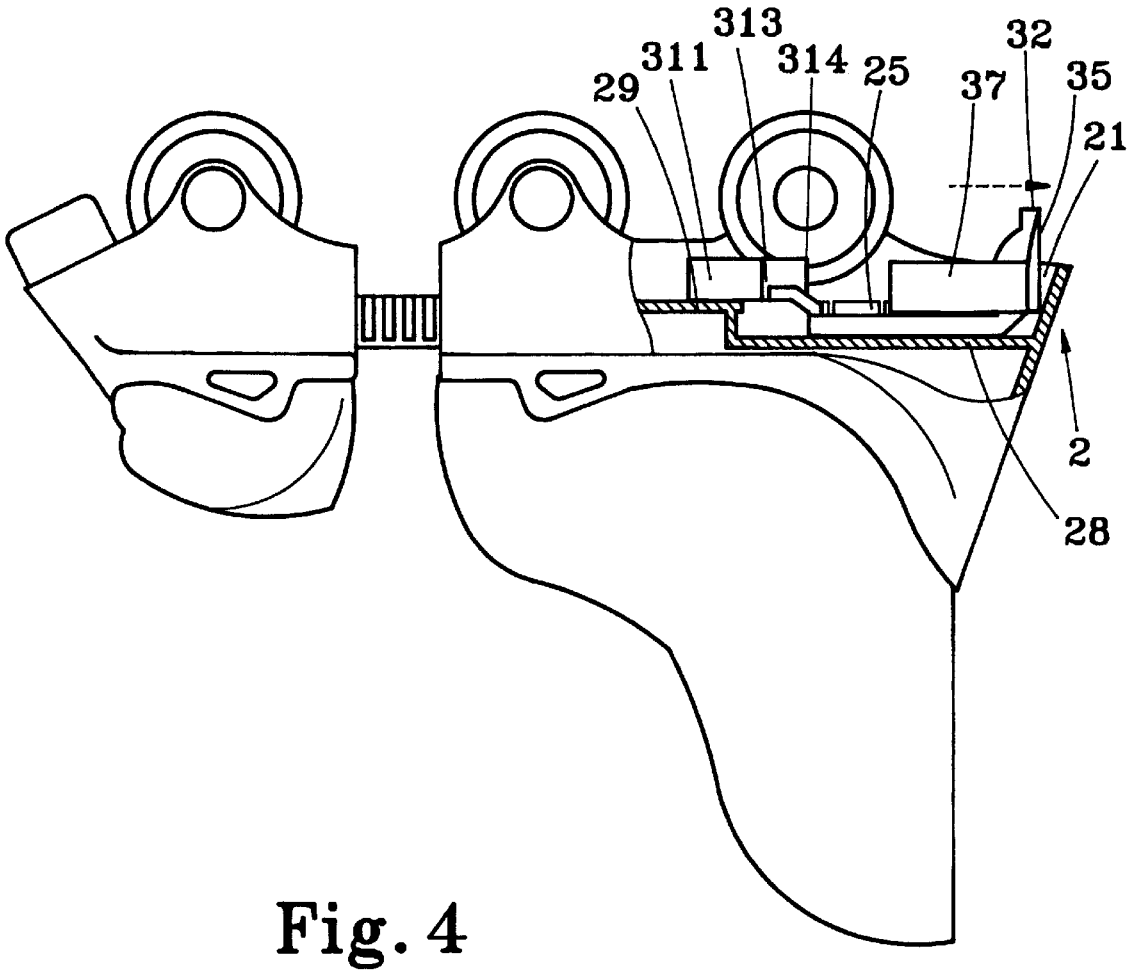
FIG. 4 is similar to FIG. 2, but showing the control device moved backwards, and the auxiliary wheels moved apart.
Figure 5:
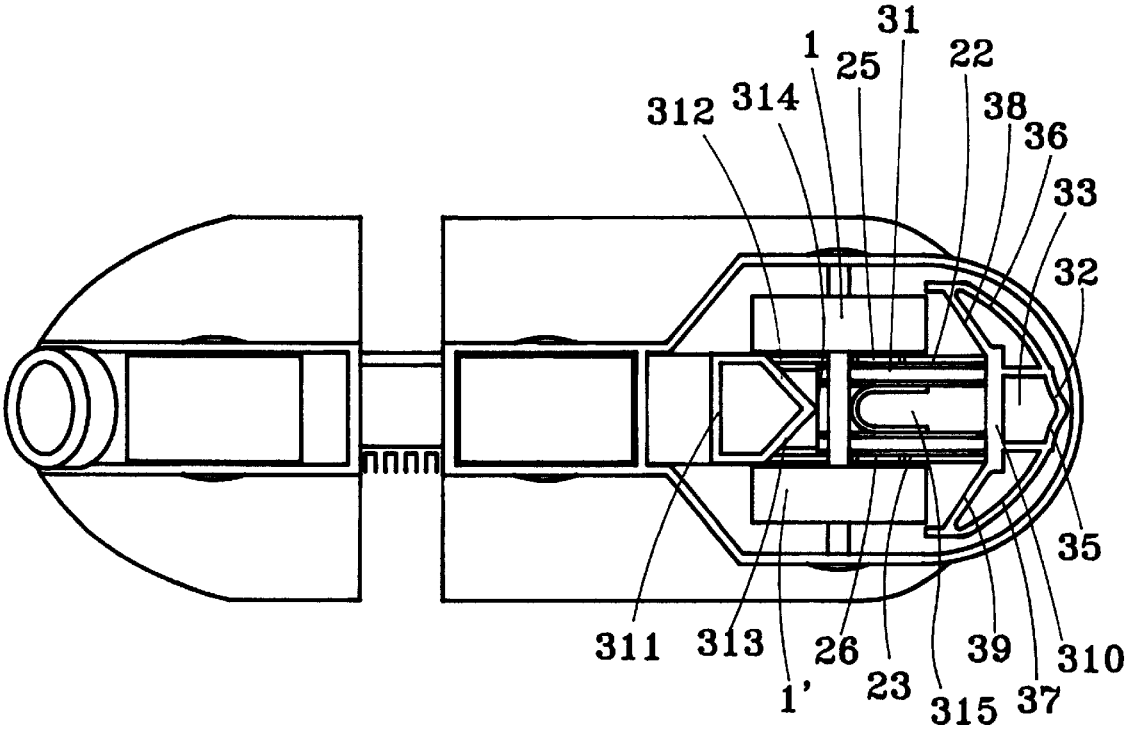
FIG. 5 is a bottom view of FIG. 4.

Referring to FIGS. 4 and 5, the control device 3 can be conveniently pushed backwards by hand through the finger plate 32 to disengage the raised portion 316 from the front locating hole 212. When the control device 3 is moved backwards, the oblique planes 312;313 of the actuating frame 311 are forced to move the auxiliary wheels 1;1' apart, and then the raised portion 316 is forced into engagement with the rear locating hole 211 to hold the control device 3 in place (see FIG. 6), and therefore the auxiliary wheels 1;1' are maintained in the apart status. When the auxiliary wheels 1;1' are maintained in the apart status, they make the roller skate more stable.

I claim:

1. An in-line roller skate comprising a sole plate equipped with a line of wheels, and an auxiliary wheel system mounted in said sole plate, wherein said auxiliary wheel system comprises:

an auxiliary wheel mounting space defined within said sole plate;

two partition plates bilaterally disposed inside said auxiliary wheel mounting space and defining a longitudinal sliding way;

two locating devices respectively mounted on said partition plates;

two support plates bilaterally disposed within said partition plates;

a stop plate connected between said partition plates at one end;

a locating plate spaced between said support plates and having a front locating hole and a rear locating holes;

two auxiliary wheels mounted on a transverse axis within said auxiliary wheel mounting space and moved between a first position in which said auxiliary wheels are retained closely attached together, and a second position in which said auxiliary wheels are spaced from each other at a space; and a control device supported on said support plates and moved in said sliding way to control the position of said auxiliary wheels, said control device comprising a base frame, a finger plate disposed at one end of said base frame through which said control device is moved by hand, two arms bilaterally extended from said finger plate which force said auxiliary wheels into said first position when said control device is moved forwards along said sliding way, an actuating frame disposed at one end of said base frame remote from said finger plate and having two oblique planes met at an actuating end adapted for pushing said auxiliary wheels into said second position when said control device is moved backwards along said sliding way, and a locating spring plate disposed in said base frame and having a raised portion for engaging the front locating hole and rear locating hole of said locating plate alternatively.

2. The in-line roller skate of claim 1, wherein a finger slot and two finger grooves are disposed at two opposite sides of said finger plate for the positioning of the fingers.

3. The in-line roller skate of claim 1, wherein said arms have a respective oblique push face adapted for pushing said auxiliary wheels into said first position.

4. The in-line roller skate of claim 1, wherein a receiving space is defined between said arms for receiving said auxiliary wheels in said first position.

* * * * *